US009962897B2

(12) United States Patent
Preamprasitchai

(10) Patent No.: US 9,962,897 B2
(45) Date of Patent: May 8, 2018

(54) CARDBOARD PACKAGING WITH INTERNAL POLYMER FRAME STRUCTURES

(71) Applicant: Viwat Bryan Preamprasitchai, San Francisco, CA (US)

(72) Inventor: Viwat Bryan Preamprasitchai, San Francisco, CA (US)

( * ) Notice: Subject to any disclaimer, the term of this patent is extended or adjusted under 35 U.S.C. 154(b) by 772 days.

(21) Appl. No.: 14/327,474

(22) Filed: Jul. 9, 2014

(65) Prior Publication Data

US 2015/0020479 A1 Jan. 22, 2015

Related U.S. Application Data

(60) Provisional application No. 61/847,967, filed on Jul. 18, 2013.

(51) Int. Cl.

| | |
|---|---|
| ***B65D 5/42*** | (2006.01) |
| ***B31B 7/00*** | (2006.01) |
| ***B65D 5/44*** | (2006.01) |

(52) U.S. Cl.

CPC ..... *B31B 7/00* (2013.01); *B65D 5/441* (2013.01)

(58) Field of Classification Search

CPC ..... B65D 5/00; B65D 5/42; B65D 65/403; B65D 2519/00019; B65D 2519/00273; B65D 19/20; B65D 2301/20; B65D 2313/02; B65D 2519/00159; B65D 2519/00323; B65D 2519/00562; B65D 2519/00621; B65D 2519/00666; B65D 5/10; B65D 5/3621; B65D 15/22;

(Continued)

(56) References Cited

U.S. PATENT DOCUMENTS 4,948,039 A * 8/1990 Amatangelo ..... B65D 5/20 229/198
5,686,180 A * 11/1997 Rivlin ..... B32B 7/12 428/350

(Continued)

OTHER PUBLICATIONS

Oxenham, Peter, and Rassie Erasmus. "Exploring Materials: Integrated Science and Technology: ABET Level 3." Exploring Materials: Integrated Science and Technology: ABET Level 3, Sached Books, Cape Town, 1999, p. 56.*

*Primary Examiner* — Lee E Sanderson
*Assistant Examiner* — Julius Fitzhugh
(74) *Attorney, Agent, or Firm* — Knobbe, Martens, Olson & Bear, LLP

(57) ABSTRACT

A new package or box type having an internal core or frame structure comprising of plastic or other polymer material sandwiched between two cardboard sheets an all sides of the box forming the outer walls of the box. The walls of the box containing the frame structure are more resistant to bursting or crushing than conventional corrugated cardboard used in the industry for transporting goods. Use of plastic or polymers applied to the core frame results in less material consumption than conventional corrugated cardboard. This invention yields higher package strength throughout the package structure and not just the edge of the package in order to negate the use of the double corrugated walls design as widely used in corrugated card board to achieve similar package strength quality while minimizing package weight and preserving exterior package composition of cardboard for handling purposes.

9 Claims, 3 Drawing Sheets

(58) Field of Classification Search
CPC .... B65D 19/0028; B65D 19/06; B65D 19/40; B65D 2519/00034; B65D 2519/00044; B65D 2519/00054; B65D 2519/00069; B65D 2519/00089; B65D 2519/00218; B65D 2519/00288; B65D 2519/00333; B65D 2519/00572; B65D 2519/00716; B65D 2519/00726; B65D 57/00; B65D 5/0227; B65D 5/0236; B65D 5/20; B65D 5/323; B65D 5/44; B65D 65/406; B65D 2519/00194; B65D 2519/00104; B65D 2519/00174; B65D 2519/00184; B65D 19/00208; B65D 2519/00338; B65D 19/00343; B65D 2519/00373; B65D 2519/00567; B65D 2519/00805; B65D 2519/0086; B65D 5/4233; B65D 5/4266; B65D 5/4279; B65D 5/443; B65D 5/445; B65D 5/46024; B65D 5/4608; B65D 5/48046; B65D 5/54; B65D 5/542; B65D 5/5435; B65D 5/563; B65D 71/0088; B65D 85/48; B31B 7/00; B31F 1/00; B32B 29/08; B32B 29/00; B32B 3/28; B32B 3/00; B32B 7/12; B32B 2307/21; B32B 29/005; B32B 3/12; B32B 19/04; B32B 2037/1276; B32B 2037/243; B32B 2250/26; B32B 2255/12; B32B 2264/108; B32B 2305/08; B32B 2307/202; B32B 2307/75; B32B 2313/04; B32B 2315/16; B32B 2317/122; B32B 2405/00; B32B 2457/202; B32B 2457/206; B32B 2519/02; B32B 2581/00; B32B 29/002; B32B 29/02; B32B 33/00; B32B 38/04; B32B 38/1866; B32B 3/266; B32B 5/022; B32B 5/024; B32B 5/26; B32B 7/08; B32B 27/10; B32B 1/04; B32B 2439/00; B29C 2035/0827; B29C 35/08; B29C 64/129; B29C 2071/022; B29C 66/52293; B29C 66/52298; B29C 70/32; B29C 71/02; B29C 35/0894; B29C 53/00; B29C 65/48; B29C 66/1122; B29C 66/1224; B29C 66/1226; B29C 66/5221; B29C 66/5225; B29C 66/5229; B29C 66/52292
USPC ..... 229/117.18, 939, 199, 122.32, 168, 5.81, 229/5.84, 930, 942; 248/346.01, 174, 248/247, 311.2, 346.03, 346.4; 206/454, 206/386, 423, 448, 456, 459.5, 561, 564, 206/583, 596, 598, 600, 706, 707, 746, 206/831; 403/172, 176, 219, 175, 217, 403/292; 220/532; 53/444, 446, 447, 53/449, 461, 475
See application file for complete search history.

(56) References Cited

U.S. PATENT DOCUMENTS 7,424,967 B2 * 9/2008 Ervin ..... A47J 36/02 228/181
2010/0310832 A1 * 12/2010 Gale ..... B65D 65/406 428/178

* cited by examiner

CARDBOARD PACKAGING WITH INTERNAL POLYMER FRAME STRUCTURES

CROSS-REFERENCE TO RELATED APPLICATIONS

This application claims the benefit of U.S. Provisional Application No. 61/847,967 filed Jul. 18, 2013 entitled "Improved Cardboard Packaging with Internal Polymer Frame Structures." The provisional patent application is incorporated by reference its entirety as fully set forth herein.

STATEMENT REGARDING FEDERALLY SPONSORED RESEARCH OR DEVELOPMENT

Not Applicable

BACKGROUND OF THE INVENTION

Field of the Invention

The disclosed subject matter is in the field of corrugated packaging, which is widely used in the shipping industry to store or transport goods. This subject matter includes improvements to corrugated cardboard boxes for other packaging made of such materials as cellulose fibers or synthetic fiber mixtures) for transporting/shipping and storing products.

Background of the Invention

Cardboard box packaging is widely used for transporting goods through shipping companies and their networks. Such packaging is subject to stresses and other compressive pressures when such cardboard boxes are stacked or mishandled (e.g., dropped). These stresses/pressures can weaken the structural frame of the cardboard box, allowing greater likelihood of damage to the boxes contents when the cardboard boxes are mishandled or transported across long distances.

Often card board boxes are corrugated, which means each wall of the boxes is defined by a fluted sheet of paper-based material between two linerboards. Since the flutes of the cardboard boxes are paper-based material, corrugated cardboard boxes tend to get damaged easily (e.g., buckled or crushed), particularly when stacked under other packages/parcels with varying shapes and weights. Although a boxes' contents help prevent inward buckling/crushing via combatting compressive pressures, the contents at times get damaged in this supporting role. Thus, a need exists for mechanisms that combat compressive pressures caused by stacked packages or mishandling.

A limitation of corrugated cardboard boxes is that the compressive strength of the package lies in the corners of the boxes. In fact, the industry test to determine the strength of a cardboard box is determined and acknowledged through the Edge Crush Test. Without strong corners, tensile and compressive strength in the sides of the box are low unless the density of the flutes are increased via the layering of cardboard sidewalls or the addition of a loadbearing cardboard wall section. Layering and adding loadbearing walls entail the use of more material to construct the box, increasing the production cost of the box. Also, additional layers or load bearing walls also increase the tare weight of the packaging, which increases the shipping costs of the package. Thus, a need exists for mechanisms that combat compressive pressures caused by stacked packages or mishandling without the use of additional layering or load bearing walls.

BRIEF SUMMARY OF THE INVENTION

Disclosed are improvements to box packaging and standard corrugated cardboard box packaging in particular. In one embodiment, boxes are improved by integrating a resilient polymer frame structure and utilizing structural engineering principles into the core frame of the box. Specifically, plastic members replace the flutes of corrugated paperboard between the exterior and interior linerboards of the packaging. Suitably, these improvements result in a higher crush strength of the package and a lower tare weight.

The disclosed packaging (sometimes referred to herein as a "smart package") improves standard corrugated cardboard boxes. Suitably, the flutes of the standard corrugated cardboard packaging are replaced with a truss structure and its accompanying structural engineering principles. This truss structure includes a core frame that suitably increases the tensile and compressive strength of the who e package and not just the package's corners. In a preferred embodiment, the core frame of the truss structure is made of polymers such as polypropylene, polyethylene, polystyrene or other suitable materials. Polypropylene, polyethylene, or polystyrene are the most preferred polymers for constructing the core frame due to their light weight, versatile strength, molding quality, and low cost. However, other types of polymers can also be used in this embodiment, such as natural or sustainable polymers.

The preferred embodiment disclosed herein achieves similar tensile and compressive strengths in elongated shaped packages (e.g., rectangular box packages) via I-beam frame structures that are inter-connected by truss structures running the length of the I-beams. These I-beams and truss frame shapes may be made of made out of polymers such as polyethylene, polypropylene, or polystyrene or other suitable polymer. However, other types of polymers can also be used in this embodiment, such as natural or sustainable polymers. The I-beam structures may be made through an injection process of the polymer or use of a mold for the shapes. Suitably, copolymer adhesive may be used to bond the polymer frame to the exterior and interior linerboards of the cardboard package.

When constructed according to this disclosure, supporting packaging walls with a polymer framed truss-structure results in the use of less material during construction when compared with typical corrugated cardboard package. The use of less materials results in a lower tare weight and material costs.

BRIEF DESCRIPTION OF THE DRAWINGS

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF THE DRAWINGS

Disclosed are preferred embodiments of a novel package container with various shapes such as but not limited to; square, rectangular, elongated or tubular shapes for transporting goods or storing purposes. When compared with standard corrugated packaging, the disclosed packaging features polymeric truss-structures instead of the corrugated cardboard flutes. In a preferred embodiment, the sidewalls of a package feature a polymer truss frame sandwiched within the exterior and interior linerboards for cardboard walls). In preferred embodiments, each section of the packaging contains polymer truss structures within its core and can consists of such polymers such as synthetic polymers like polyethylene, polypropylene, or polystyrene due to their strength qualities and low costs. Other types of natural, synthetic and sustainable polymers can be utilized, including polymer blends.

Figure 1:
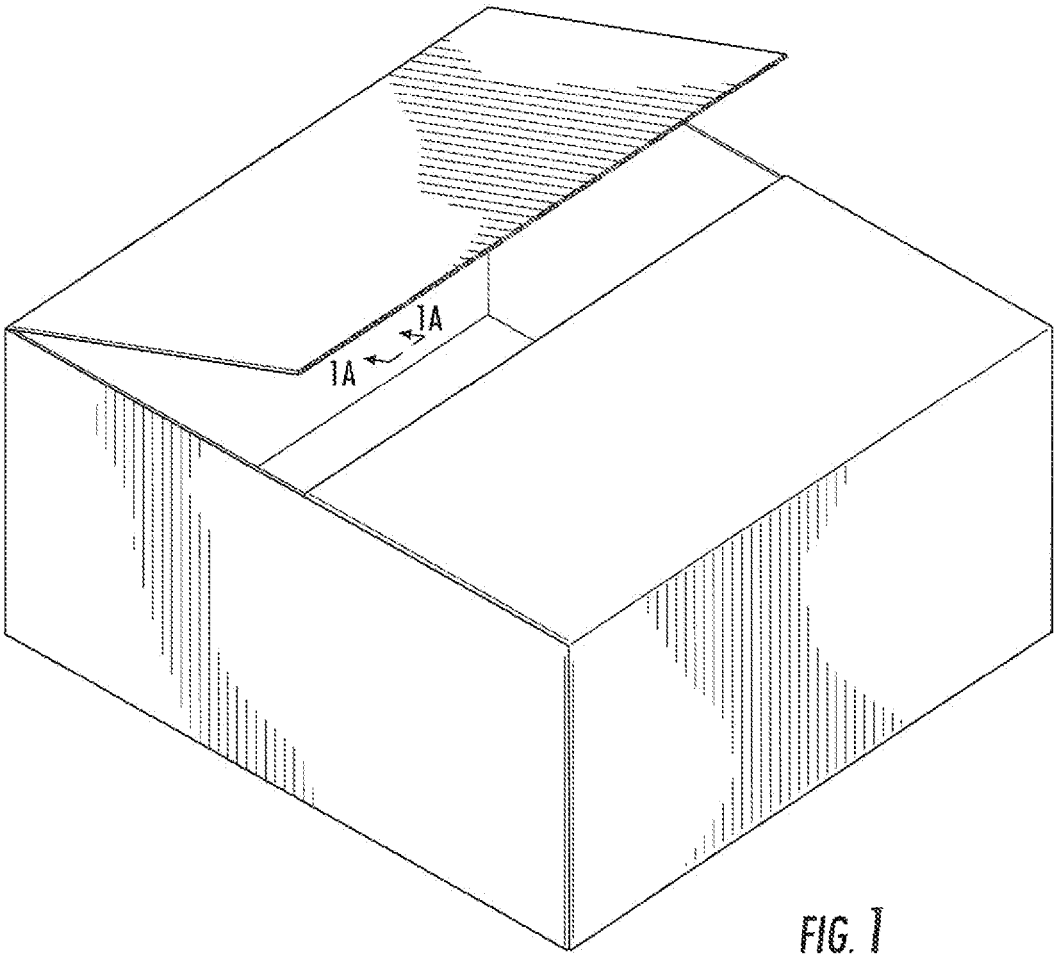
FIG. 1 is a perspective view of a boxed package.

FIG. 1 shows a perspective illustration of a square box package with a view of the flap at the top of the box slightly raised. In this illustration, an example of an internal truss core (1A) structure made of synthetic polymer such as polypropylene or polyethylene is shown sandwiched between the inner and outer layers of cardboard and bonded by a copolymer adhesive. 1.1 and 1.2 shows where the polymer is molded or injected at the top and bottom of the interior and exterior cardboard sheets and runs the surface area of the box from edge to edge. 1.3 shows the open area truss structure running the full length from edge to edge and has only the frame structure as opposed to continuing flutes with filled walls separating each section of flute.

Figure 1A:
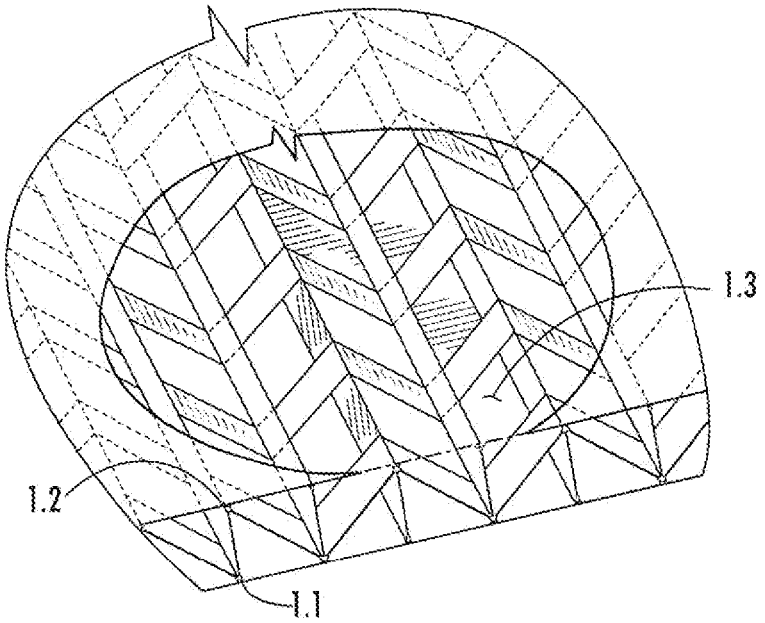
FIG. 1A is a zoom-in see-through perspective view of a portion of the box of FIG. 1.

As highlighted in FIG. 1, each section of the package walls contain a truss frame structure formed either through an injection or mold process that shapes the truss structure between the interior and exterior cardboard walls. An illustration of one example of a truss frame can be seen in FIG. 1A and FIG. 2 where glue, copolymer adhesive, or other suitable material (2.3) is used or injected at the truss joints to bond the polymer truss support rods 2.1 to the interior and exterior walls of the cardboard. In some embodiments, at each joint section of the truss as indicated in 2.2 there may be more polypropylene or other polymer used or injected to increase the thickness and surface area at the bases in forming the reinforcements.

Figure 2:
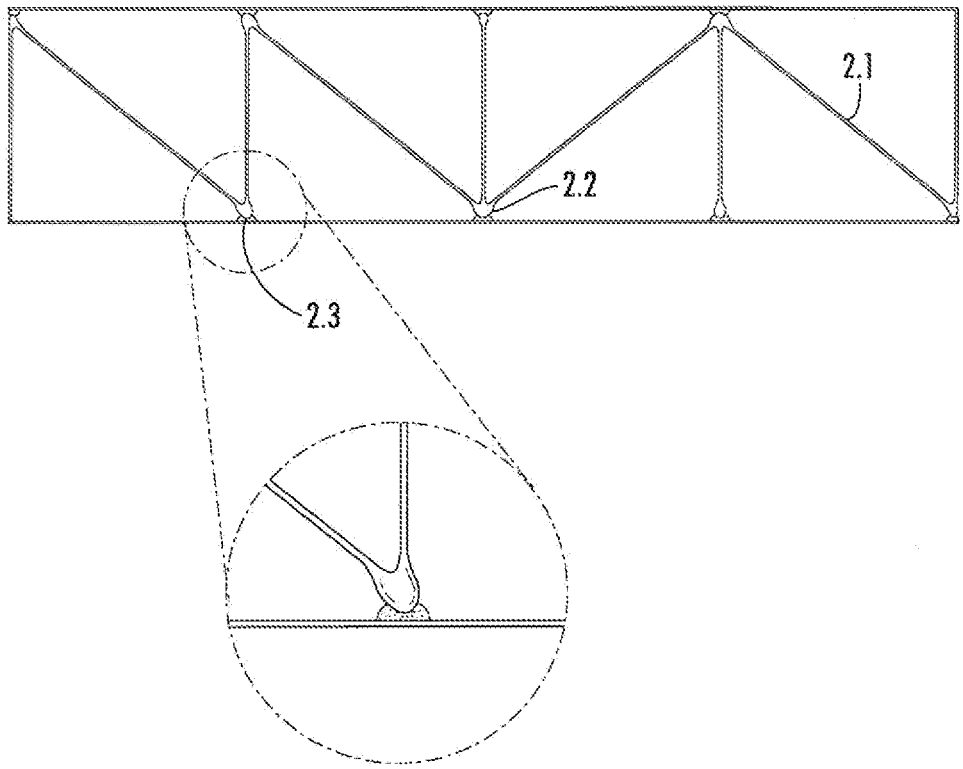
FIG. 2 is a zoom in side view of a side wall of the box of FIG. 1.

FIG. 2 illustrates a close up side view of an internal truss frame structure as described in various embodiments herein. In this example, the internal truss frame structure is shown between two sheets of cardboard with highlighted reinforcement at the joints to illustrate how synthetic polymers such as poly propylene or polyethylene may be injected and shaped into the truss structure. A separate line underneath and running parallel to the frame indicates the copolymer adhesive bonding the polymer to the cardboard. 2.1 illustrates the polymer running from the base or bottom of the cardboard wall section to the top section of the cardboard wall to form a truss. 2.2 illustrates an example of a reinforced area at the bases of the truss where more polymer may be injected. 2.3 is a close up view of a copolymer adhesive that bonds the polymer to the cardboard wall sections at the bases of the truss.

Figure 3:
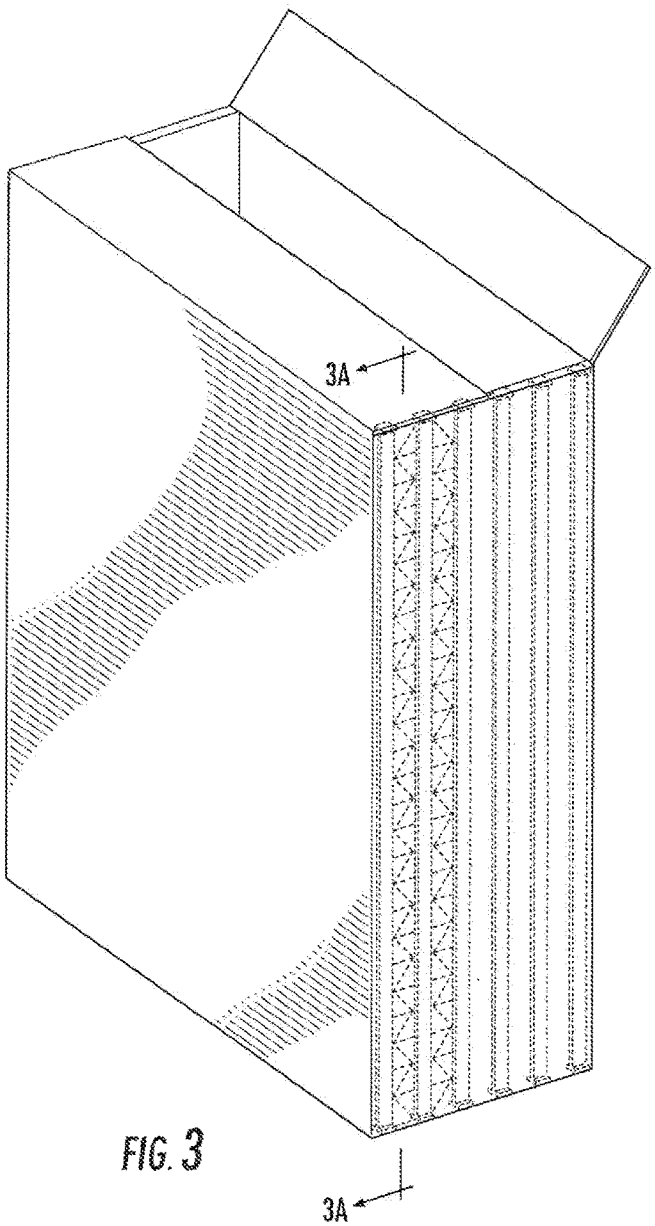
FIG. 3 is a perspective view of an alternate embodiment of boxed packaging.
Figure 3A:
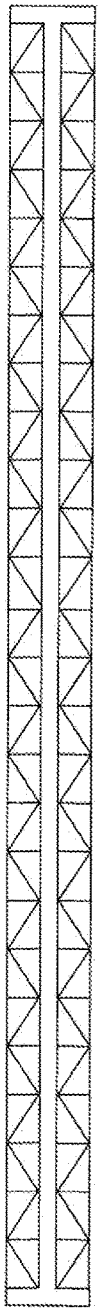
FIG. 3A is a side view of a truss-structure of the boxed packaging of FIG. 3.

FIG. 3 illustrates another embodiment of the invention showing a perspective view of a rectangular package box. FIG. 3A shows an alternative frame structure wherein an I-Beam polymer structure is supported by truss polymer structures on the vertical axis to compensate for demand needs due to a more elongated package shape. In the close up view, the I-Beams are interconnected with truss structures as a means to provide greater compressive strength due to the elongated shape of the package. Although the I-Beam and truss structures are used in the illustrations, the invention comprises an embodiment for the polymer structure to utilize a honeycomb structure for simplistic means.

Another embodiment of the invention involves longer or elongated shaped boxes such as a rectangular package box as shown in FIG. 3 and is used to transport or store similar shaped contents. With a larger surface area, there are greater risks for the package and especially the mid-section of the package to buckle or collapse when excessive pressure is placed on these areas. Usually this happens when other boxes are stacked on top of this type of package or when handling this package, the weight of the content exceeds the strength of the wall of the rectangular side of the box. As such, FIG. 3 illustrates a rectangular package box where the core structure sandwiched between the interior and exterior cardboard walls (FIG. 3A) shows polymer structures molded in the shape of I-Beams and runs from the top edge of the package box to the bottom edge of the package box. In the illustration of FIG. 3A, multiple I-Beam structures cover the length or surface area of the package box walls to increase strength and distribute package stress when outside pressures are placed on any particular section of the package box. Once I-Beam structures are molded or located between the interior and exterior cardboard walls, each I-Beam may be connected via an injection process where polymers truss structures connect each I-Beam (shown by example in FIG. 3 dotted lines). Copolymer adhesive, glue, or other suitable material may be used or injected at the joint sections to bond the polymer frame to the interior and exterior cardboard walls. For illustration purposes, FIG. 3 and FIG. 3A provides a side view of the I-Beams and inter-connected truss structures but in preferred embodiments, the I-Beam and truss structures are rotated 90 degrees and therefore sit sandwiched between the interior and exterior cardboard walls.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

I claim:

1. A composite package for use in the shipping industry for transporting goods to consumers where said composite package comprises:

a plurality of sides where at least one side is defined by an interior sheet of cardboard, an exterior sheet of cardboard, and an inner support frame structure constructed from one or more materials comprising a polyethylene, a polypropylene, or a polystyrene material;

wherein the inner support frame structure is an open air truss structure comprising an open air grid structure formed by:

an array of rigid straight weft rails; and an array of rigid warp rails that are situated in a point-to-point manner through the array of rigid straight weft rails, wherein a set of quadrilateral spaces formed by an intersection of the array of rigid straight weft rails and the array of rigid warp rails are devoid of material;

wherein the inner support frame structure is sandwiched between the exterior and interior sheets of cardboard to establish said at least one side of the package;

wherein the rigid straight weft rails define either vertical or horizontal braces for said at least one side of the package and so that the array of rigid warp rails define either of diagonal or chevron braces for said at least one side of the package;

wherein the inner support frame includes reinforced corners at each intersection point between the rigid straight weft rails and the rigid warp rails, the reinforced corners comprising an injected polypropylene, polystyrene, or polyethylene material;

wherein the inner support frame is bonded to the interior sheet of cardboard and the exterior sheet of cardboard via a copolymer adhesive creating an increased thickness at connection points with the interior sheet of cardboard or the exterior sheet of cardboard compared to a remainder of the inner support frame structure; and wherein one or more of the rigid straight weft rails or the rigid warp rails increase in thickness as the one or more of the rigid straight weft rails or the rigid warp rails approach the connection points with the interior sheet of cardboard or the exterior sheet of cardboard.

2. The composite package set forth in claim 1, wherein said plurality of sides is six sides; and wherein the inner support structure is included in all six sides of the composite package.

3. The composite package as set forth in claim 1, wherein said rigid straight weft rails and the rigid warp rails are polymers and are produced via high pressure injection molds whereby said interior and exterior cardboard sheets are reinforced at a plurality of points within said point-to-point configuration of the open air truss structure.

4. The composite package as set forth in claim 1, wherein said inner support frame is included in each side of said plurality of sides and wherein the rigid straight weft rails and the rigid warp rails have varying gauges of thickness.

5. The composite package as set forth in claim 1, wherein said straight weft rails comprise I-beams that support and redistribute pressure applied to said at least one side.

6. The composite package as set forth in claim 1, wherein the inner support frame structure further comprises an I-Beam polymer structure comprising a column structural member spanning the length of the package box walls, wherein the I-Beam polymer structure distributes package stress when outside pressures are placed on the composite package.

7. The composite package as set forth in claim 1, wherein the inner support frame structure further comprises a honeycomb polymer structural member spanning the length of the composite package, wherein the honeycomb polymer structure distributes package stress when outside pressures are placed on the composite package.

8. A method of manufacturing a composite package comprising:

creating a plurality of sides of the composite package, wherein at least one side comprises an interior sheet of cardboard, an exterior sheet of cardboard, and an inner support frame structure constructed from one or more materials comprising a polyethylene, a polypropylene, or a polystyrene material;

wherein the inner support frame structure is an open air truss structure comprising an open air grid structure formed by:

an array of rigid straight weft rails; and an array of rigid warp rails that are situated in a point-to-point manner through the array of rigid straight weft rails, wherein a set of quadrilateral spaces formed by an intersection of the array of rigid straight weft rails and the array of rigid warp rails are devoid of material;

wherein the inner support frame structure is sandwiched between the exterior and interior sheets of cardboard to establish said at least one side of the package;

wherein the rigid straight weft rails define either vertical or horizontal braces for said at least one side of the package and so that the array of rigid warp rails define either of diagonal or chevron braces for said at least one side of the package;

wherein the inner support frame includes reinforced corners at each intersection point between the rigid straight weft rails and the rigid warp rails, the reinforced corners comprising an injected polypropylene, polystyrene, or polyethylene material;

wherein the inner support frame is bonded to the interior sheet of cardboard and the exterior sheet of cardboard via a copolymer adhesive creating an increased thickness at connection points with the interior sheet of cardboard or the exterior sheet of cardboard compared to a remainder of the inner support frame structure; and wherein one or more of the rigid straight weft rails or the rigid warp rails increase in thickness as the one or more of the rigid straight weft rails or the rigid warp rails approach the connection points with the interior sheet of cardboard or the exterior sheet of cardboard.

9. The method of manufacturing the composite package as set forth in claim 8, wherein the inner support frame further comprises an I-Beam polymer structure comprising a column structural member spanning the length of the package box walls, wherein the I-Beam polymer structure distributes package stress when outside pressures are placed on the composite package.

* * * * *